US010894178B2

(12) United States Patent
Spillman et al.

(10) Patent No.: US 10,894,178 B2
(45) Date of Patent: Jan. 19, 2021

(54) SYSTEM, METHOD AND APPARATUS FOR EXERCISE DEVICE

(71) Applicant: CHOPFIT, LLC, Austin, TX (US)

(72) Inventors: Jonathan Spillman, Austin, TX (US); Anna D. Cardinal, Austin, TX (US); Deepak Selvaraj, Austin, TX (US); Redza Shah, Austin, TX (US); Paul T. Williams, Austin, TX (US)

(73) Assignee: ChopFit, LLC, Austin, TX (US)

( * ) Notice: Subject to any disclaimer, the term of this patent is extended or adjusted under 35 U.S.C. 154(b) by 0 days.

(21) Appl. No.: 16/890,781

(22) Filed: Jun. 2, 2020

(65) Prior Publication Data

US 2020/0376314 A1 Dec. 3, 2020

Related U.S. Application Data

(60) Provisional application No. 62/856,364, filed on Jun. 3, 2019.

(51) Int. Cl.

| | |
|---|---|
| ***A63B 15/00*** | (2006.01) |
| ***A63B 21/00*** | (2006.01) |
| ***A63B 21/06*** | (2006.01) |
| ***A63B 21/072*** | (2006.01) |

(52) U.S. Cl.

CPC ..... *A63B 15/00* (2013.01); *A63B 21/0604* (2013.01); *A63B 21/072* (2013.01); *A63B 21/151* (2013.01); *A63B 21/4035* (2015.10)

(58) Field of Classification Search

CPC ..... A63B 15/00; A63B 21/072; A63B 21/151; A63B 21/0604; A63B 21/4035

See application file for complete search history.

(56) References Cited

U.S. PATENT DOCUMENTS

| | | | |
|---|---|---|---|
| 3,231,281 | A | 1/1966 | Wallo |
| 4,302,008 | A | 11/1981 | Lard |
| 6,692,386 | B2 | 2/2004 | Brundage |
| 7,766,760 | B2 | 8/2010 | Priester et al. |
| 8,491,422 | B2 | 7/2013 | Deschesnes et al. |
| 8,864,608 | B2 | 10/2014 | Rockhill |
| 9,446,280 | B2 | 9/2016 | Feinman et al. |
| 10,029,134 | B2 | 7/2018 | Gavigan |
| 2005/0176561 | A1 | 8/2005 | Soukeras |
| 2010/0204020 | A1 | 8/2010 | Thomas et al. |
| 2012/0149539 | A1 | 6/2012 | Quader |
| 2014/0051554 | A1 | 2/2014 | Walker |
| 2014/0057763 | A1 | 2/2014 | Fritsch |
| 2014/0213422 | A1 | 7/2014 | Marcus |
| 2014/0309081 | A1 | 10/2014 | Gavigan |

(Continued)

OTHER PUBLICATIONS https://www.xchain.training/about, four pages.

(Continued)

*Primary Examiner* — Garrett K Atkinson

(74) *Attorney, Agent, or Firm* — Dickinson Wright, PLLC; Michael E. Noe, Jr.

(57) ABSTRACT

An exercise device can include a handle having a handle axis and a handle weight. A head can be removably coupled to a distal end of the handle with a single fastener adjacent a proximal end of the head. The head can have a head weight and can be axe-shaped. A distal end of the head can be blunt. A portion of each of the proximal and distal ends can be planar.

17 Claims, 12 Drawing Sheets

(56) References Cited

U.S. PATENT DOCUMENTS

| | | | |
|---|---|---|---|
| 2015/0045192 | A1 | 2/2015 | Weck et al. |
| 2020/0061485 | A1 * | 2/2020 | Wendorff et al. |

OTHER PUBLICATIONS https://www.weckmethod.com/products/rmt-club-functional-training-equipment-full-body-workout-hiit, 12 pages.
https://most-fit.com/products/mostfit-core-hammer, three pages.
https://www.roguefitness.com/sisu-war-hammer, eight pages.
https://www.onnit.com/onnit-steel-mace/, 19 pages.
https://www.onnit.com/onnit-steel-clubs/, 17 pages.
https://www.gopherperformance.com/saq/core-training/corepro-maces, three pages.
https://www.hyperwear.com/sandbell/, 11 pages.

* cited by examiner $F_1$ = 6.7 lbs, (L = H)
$F_2$ = 10.8 lbs, (L = 2H)
$F_3$ = 15.0 lbs, (L = 3H)

$F_A = W(1+\frac{L}{H})$ $F_B = \frac{L}{H}W$ $F_A = F_B = \frac{X}{H}W$ $F_C = W$

X = 2.7"

H = 3.5" (Hand Width)

$F_1 = F_1 = F_3 = 4.4$ lbs $F_1$ = 6.3 lbs, (L = H, l = -H)

$F_2$ = 11.7 lbs, (L = 2H, l = 0)

$F_3$ = 17.2 lbs, (L = 3H, l = H)

$$F_A = \frac{W_{Head}(L + H) + W_{Handle}(l + H)}{H}$$

$$F_B = \frac{LW_{Head} + lW_{Handle}}{H}$$

$$F_A = F_B = \frac{X}{H} W_{Head}$$

$$F_C = W_{Head} + W_{Handle}$$

X = 2.0" (Head CoM)

H = 3.5" (Hand Width)

$F_1 = F_1 = F_3 = 4.7$ lbs

SYSTEM, METHOD AND APPARATUS FOR EXERCISE DEVICE

This application claims priority to and the benefit of U.S. Prov. Pat. App. No. 62/856,364, filed Jun. 3, 2019, which is incorporated herein by reference in its entirety.

BACKGROUND

Technical Field

This disclosure generally relates to exercise and, in particular, to a system, method and apparatus for an exercise device.

Description of the Related Art

Fitness programs and equipment can be limited by cumbersome size and significant cost. Many conventional systems also are limited to certain functionalities and/or muscle groups of the user, and can lack integration. In particular, incorporating a full-body cardio and strength workout can be challenging. Adaptability in equipment also can be limited, and the amount of time required for some routines and equipment can be extensive. Other programs are not well suited for phone app driven performance tracking of the user. Although conventional solutions are workable, improvements continue to be of interest.

SUMMARY

Embodiments of a system, method and apparatus for an exercise device are disclosed. For example, the exercise device can include a handle having a handle axis and a handle weight. A head can be removably coupled to a distal end of the handle with a single fastener adjacent a proximal end of the head. The head can have a head weight, and can be axe-shaped. A distal end of the head can be blunt. A portion of each of the proximal and distal ends can be planar.

Other embodiments of the exercise device can include a head weight that is distributed asymmetrically with respect to a geometric center of the head in at least one of x, y and z-axes of the head. Proximal and distal ends of the head can be substantially parallel to each other. In addition, side walls on opposing lateral sides of the head can be substantially parallel to each other.

Still other embodiments of the exercise device can include a handle with handle proximal, middle and distal portions. When the handle distal portion is gripped by the user and the handle is vertical, a total perceived weight of the exercise device perceived by the user can be at least about 10% greater than the head weight, and not greater than about 100% of the head weight. In addition, when the handle middle portion is gripped by the user and the handle is vertical, a total perceived weight of the exercise device perceived by the user can be at least about 25% greater than the head weight, and not greater than about 150% of the head weight. Further, when the handle proximal portion is gripped by the user and the handle is vertical, a total perceived weight of the exercise device perceived by the user can be at least about 50% greater than the head weight, and not greater than about 200% of the head weight.

The perceived weight can be 120% to 240% of the head weight at the proximal portion of the handle, 120% to 380% of the head weight at central portion, and 120% to 520% of the head weight at the distal portion. This performance from the user's perspective is with respect to the total weight (head and handle). The perceived weight also can be 90% to 210% of the total weight of the device at the proximal portion of the handle, 90% to 340% of the device total weight at central portion of the handle, and 90% to 480% of the device total weight at the distal portion of the handle.

BRIEF DESCRIPTION OF THE DRAWINGS

For a detailed description of example embodiments, reference will now be made to the accompanying drawings in which.

NOTATION AND NOMENCLATURE

Figure 1:
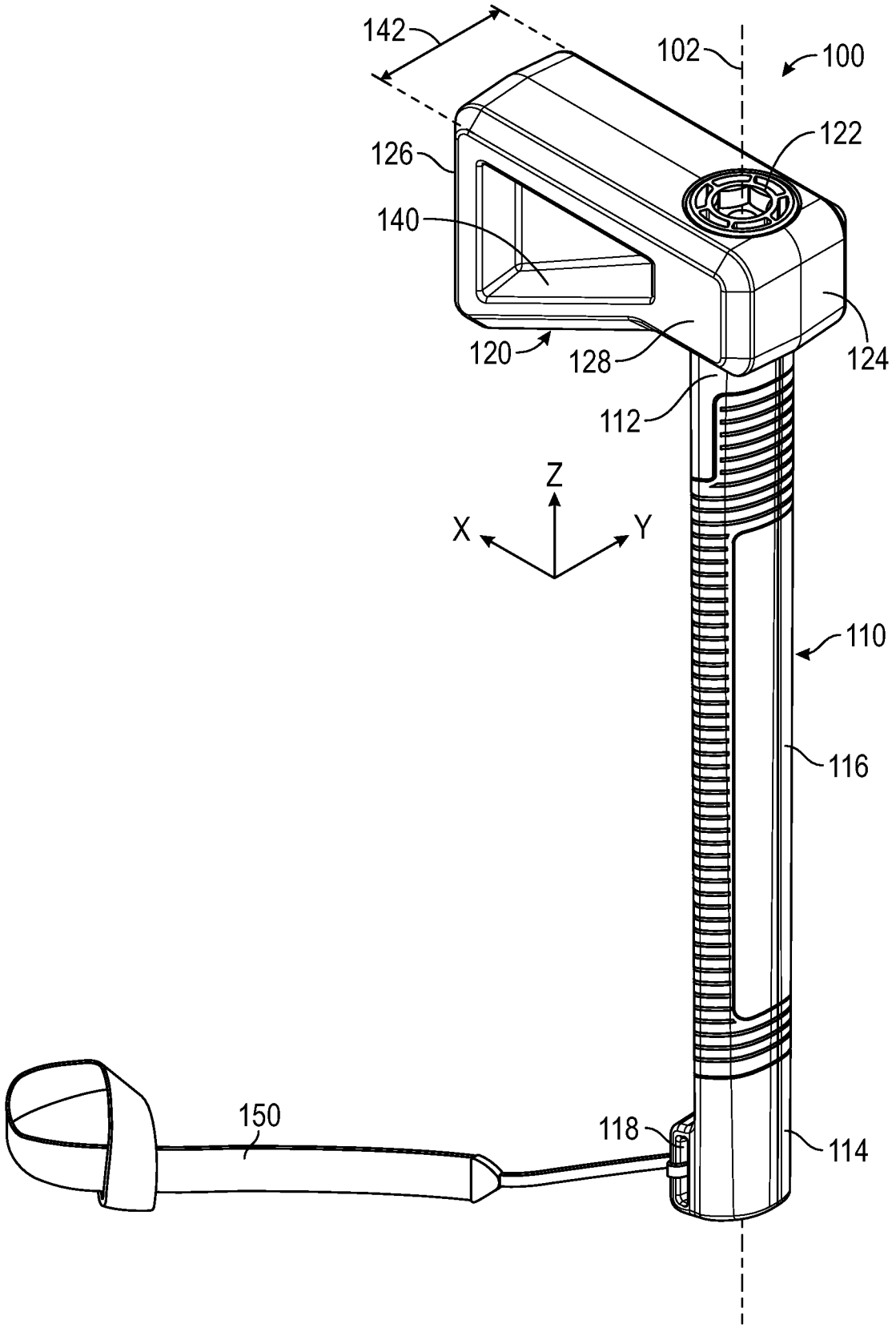
FIG. 1 is a perspective view of an embodiment of an exercise device.
Figure 2:
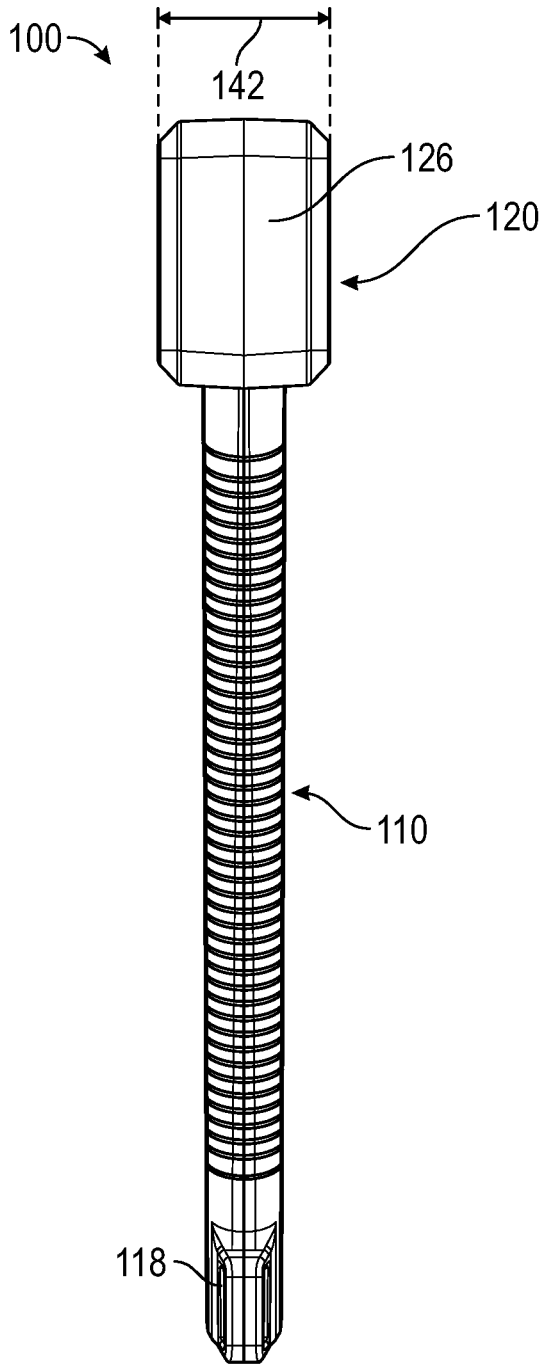
FIG. 2 is a front view of the device of FIG. 1.
Figure 3:
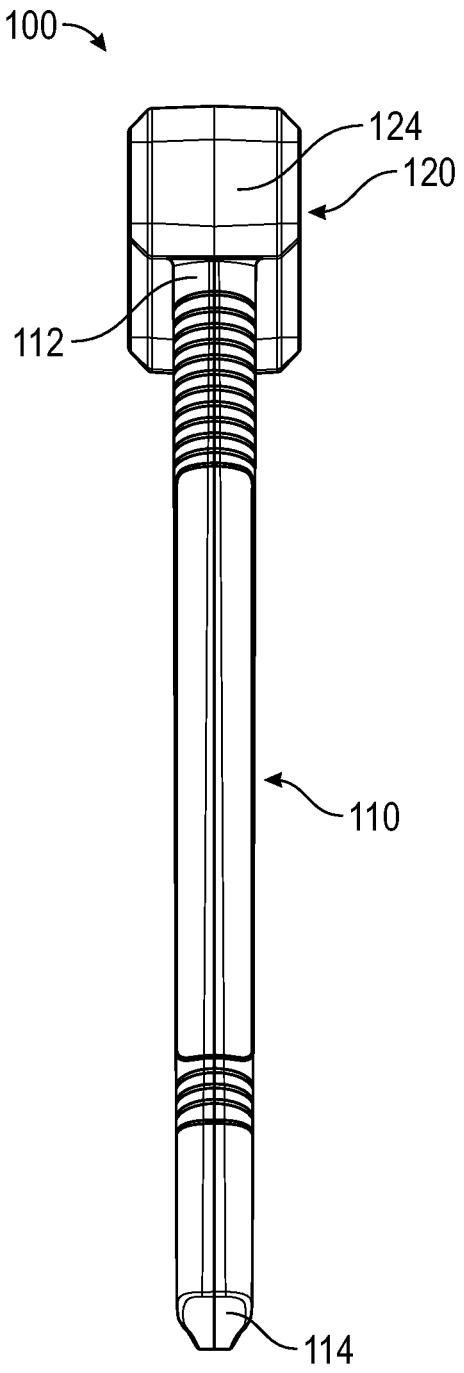
FIG. 3 is a rear view of the device of FIG. 1.
Figure 4:
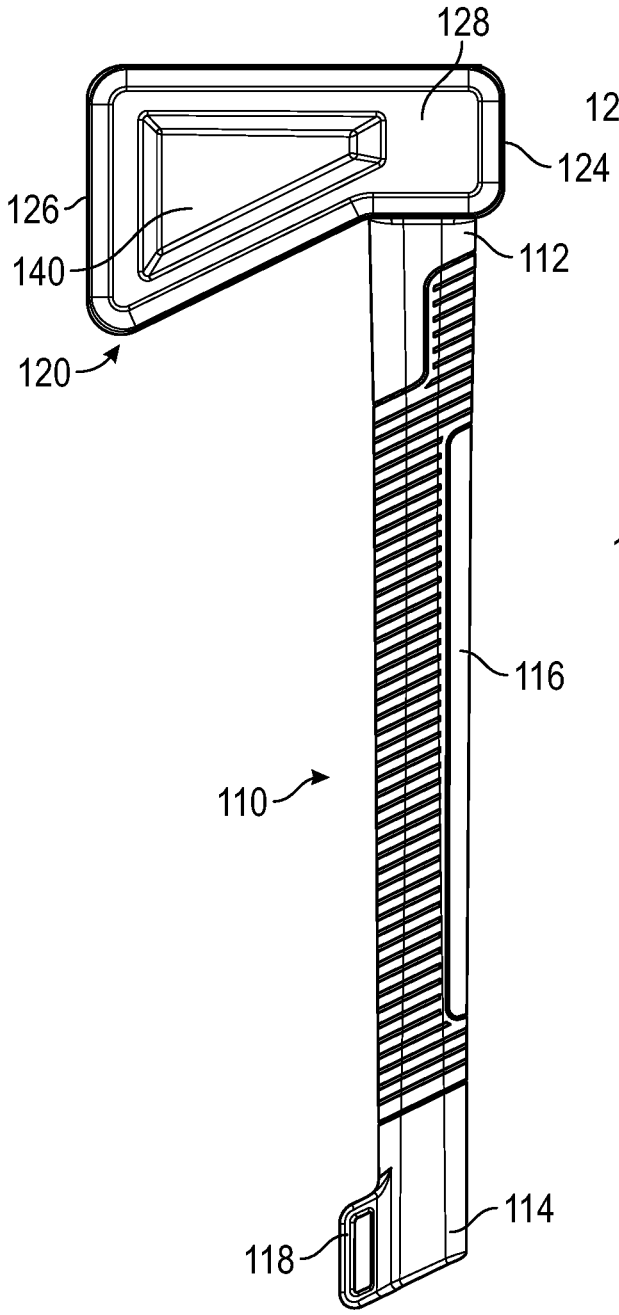
FIG. 4 is a left side view of the device of FIG. 1.
Figure 5:
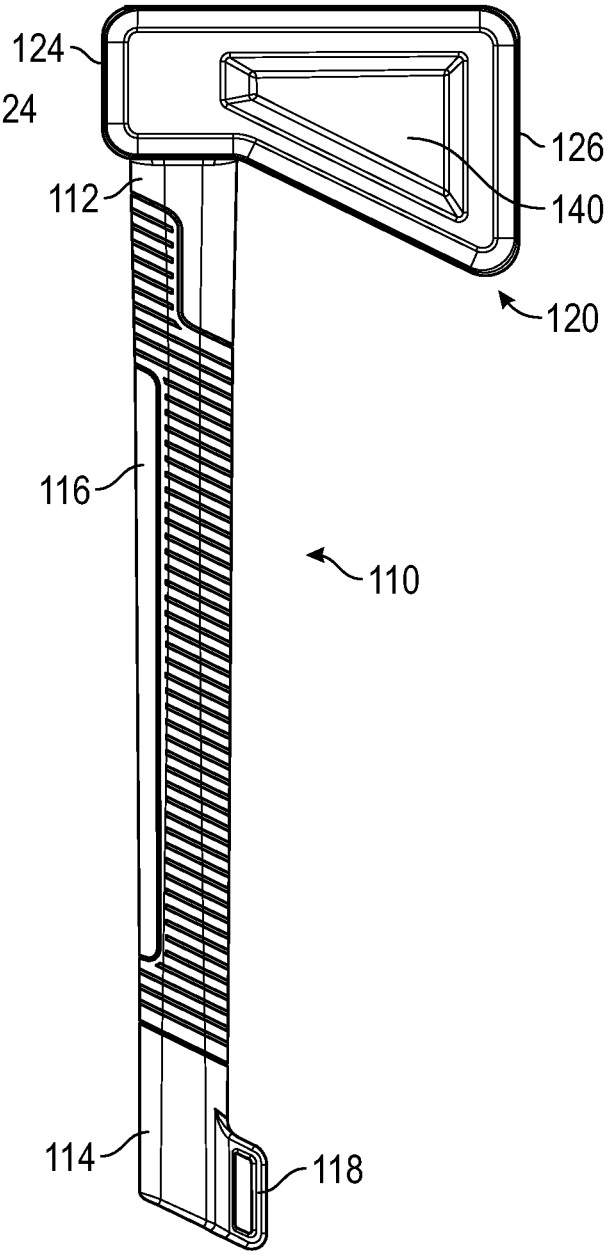
FIG. 5 is a right side view of the device of FIG. 1.
Figure 6:
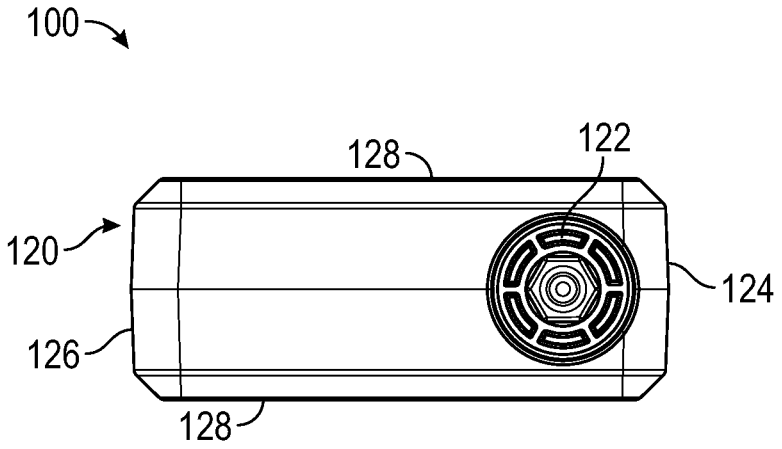
FIG. 6 is a top view of the device of FIG. 1.
Figure 7:
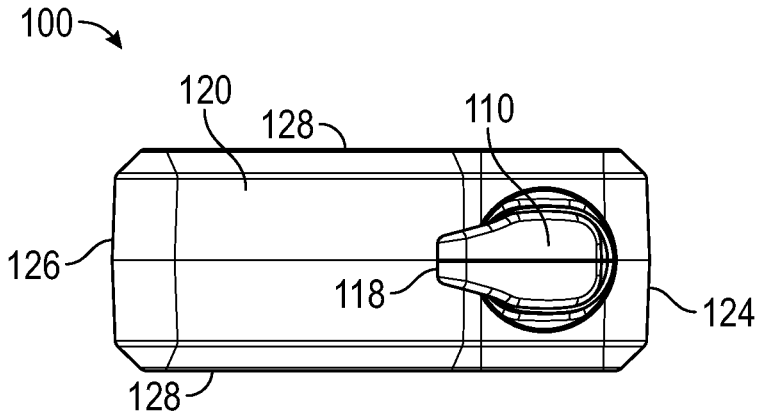
FIG. 7 is a bottom view of the device of FIG. 1.

Various terms are used to refer to particular system components. Different companies may refer to a component by different names this document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

Perceived Weight can be defined as the magnitude of the forces acting on the user's hands.

Fixtures. The user's hands are modeled as two points which fix translational motion. These points are located on the handle and spaced about 9 cm (3.5") apart.

Forces. In some examples, two external forces are represented in this model: the head's weight and the handle's weight.

Head Weight. The head's weight is modeled as a point force at the proximal end of the handle. Its radial distance from the handle's axis is equal to the distance between the head's center of mass and the handle's axis.

Handle Weight. The handle weight is modeled as a point force on the handle's axis. It is on a plane defined coincident to the handle's center of mass and normal to the handle's axis.

Analysis is for a static system. Analysis of the device in motion could yield higher perceived weights.

The system can be treated as two massless rigid bars. One bar is on the handle shaft's axis. The second bar connects the source of the point force representing the head's weight to the handle's axis.

The terminology used herein is for the purpose of describing particular example embodiments only, and is not intended to be limiting. As used herein, the singular forms "a," "an," and "the" may be intended to include the plural forms as well, unless the context clearly indicates otherwise. The method steps, processes, and operations described herein are not to be construed as necessarily requiring their performance in the particular order discussed or illustrated, unless specifically identified as an order of performance. It is also to be understood that additional or alternative steps may be employed.

The terms first, second, third, etc. may be used herein to describe various elements, components, regions, layers and/or sections; however, these elements, components, regions, layers and/or sections should not be limited by these terms. These terms may be only used to distinguish one element, component, region, layer or section from another region, layer or section. Terms such as "first," "second," and other numerical terms, when used herein, do not imply a sequence or order unless clearly indicated by the context. Thus, a first element, component, region, layer or section discussed below could be termed a second element, component, region, layer or section without departing from the teachings of the example embodiments. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. In another example, the phrase "one or more" when used with a list of items means there may be one item or any suitable number of items exceeding one.

Spatially relative terms, such as "inner," "outer," "beneath," "below," "lower," "above," "upper," "top," "bottom," and the like, may be used herein. These spatially relative terms can be used for ease of description to describe one element's or feature's relationship to another element(s) or feature(s) as illustrated in the figures. The spatially relative terms may also be intended to encompass different orientations of the device in use, or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptions used herein interpreted accordingly.

DETAILED DESCRIPTION

The following discussion is directed to various embodiments. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

As shown in FIGS. 1-15, various embodiments of a system, method and apparatus for an exercise device are shown. For example, FIG. 1 depicts an exercise device 100 having a handle 110 with a handle axis 102 and a handle weight.

A head 120 can be removably or permanently coupled to the handle 110. In one version, a single fastener 122 (FIG. 8) can couple them together adjacent a proximal end 124 of the head 120. The head 120 can comprise a head weight. Embodiments can include the ability to remove the fastener 122 and change the head 120 to an alternate version of the head 120 (e.g., a lighter head, a heavier head, a different-shaped head, etc.). This can be done with the same or different handle 110 and fastener 122.

In some examples, the handle weight can be not greater than about 45% (e.g., for the lightweight version), 40%, 30%, 25% (e.g., for the standard version), 20% or even 15% (e.g., for the heavyweight version) of the head weight. In other examples, the handle weight can be not less than about 40%, 30% (e.g., lightweight), 25%, 20%, 15% (e.g., standard) or even 10% (e.g., heavyweight) of the head weight. Embodiments of the handle 110 can include no metallic components, other than fasteners to couple handle portions of the handle together. Compare FIGS. 8 and 10.

Embodiments of the head 120 can be generally axe-shaped. A distal end 126 of the head 120 can be blunt. Optionally, a portion of each of the proximal end 124 and the distal end 126 can be planar or generally planar. In one version, the proximal end 124 and the distal end 126 can be parallel or substantially parallel to each other. The head 120 can include side walls 128 on opposing lateral sides thereof. The sidewalls 128 can be parallel or substantially parallel to each other.

The head 120 can include a core 130 (compare FIGS. 9 and 11) that can be coated or overmolded with an exterior material 131, such as a polymer. The core 130 can comprise at least one of a polymer and a metal, such as aluminum, a zinc alloy, etc. The head weight can be distributed symmetrically or asymmetrically. In some examples (FIG. 12), the head weight can be distributed asymmetrically with respect to a geometric center (GC) of the head in at least one of x, y and z-axes of the head 120. The GC can be located where the center of mass would be if the overall device had a uniform density. The asymmetric weight distribution of the device relocates the geometric center away from the center of mass.

In some embodiments, the head 120 can include a center of mass (CM) that can be spaced apart from the handle axis 102 by at least about 3 cm. For the lightweight head alone, the center of mass can be at least about 6 cm from the handle axis 102. In one version, at least about 25% of the head weight, or total weight of the device 100, can be located within about 2.5 cm of the handle axis. Optionally, not greater than about 60% of the head weight (or total weight) can be located within about 2.5 cm of the handle axis 102.

In still other embodiments, at least about 50% of the head weight can be located within about 6 cm of the handle axis 102. Optionally, not greater than about 80% of the head weight can be located within about 6 cm of the handle axis 102. In additional versions, at least about 20% of the head weight can be located within about 2.5 cm of the distal end 126 of the head 120. Optionally, not greater than about 50% of the head weight can be located within about 2.5 cm of the distal end 126 of the head 120.

Embodiments of the exercise device 100 can further include one or more concave recesses 140 formed in lateral sides of the head 120. For example, each concave recess 140 can be asymmetric in at least one dimension. The head 120 can include a head width 142. Each concave recess 140 can extend into the head 120 in a range of at least about 10% of the head width 142. Optionally, each concave recess can extend into the head by not greater than about 40% of the head width 142. In operation, one or both of recesses 140 can be used as an alternate or additional location for the user to grip the exercise device 100.

Versions of the handle 110 can include a handle distal portion 112 adjacent to the head 120, a handle proximal portion 114 opposite the handle distal portion 112, and a handle middle portion 116 located between the handle distal and proximal portions 112, 114. Each of these can be configured to be gripped by a user. The handle proximal portion 114 can include a loop 118 configured to be secured to a hand strap 150 of a user of the exercise device 100.

Figure 8:
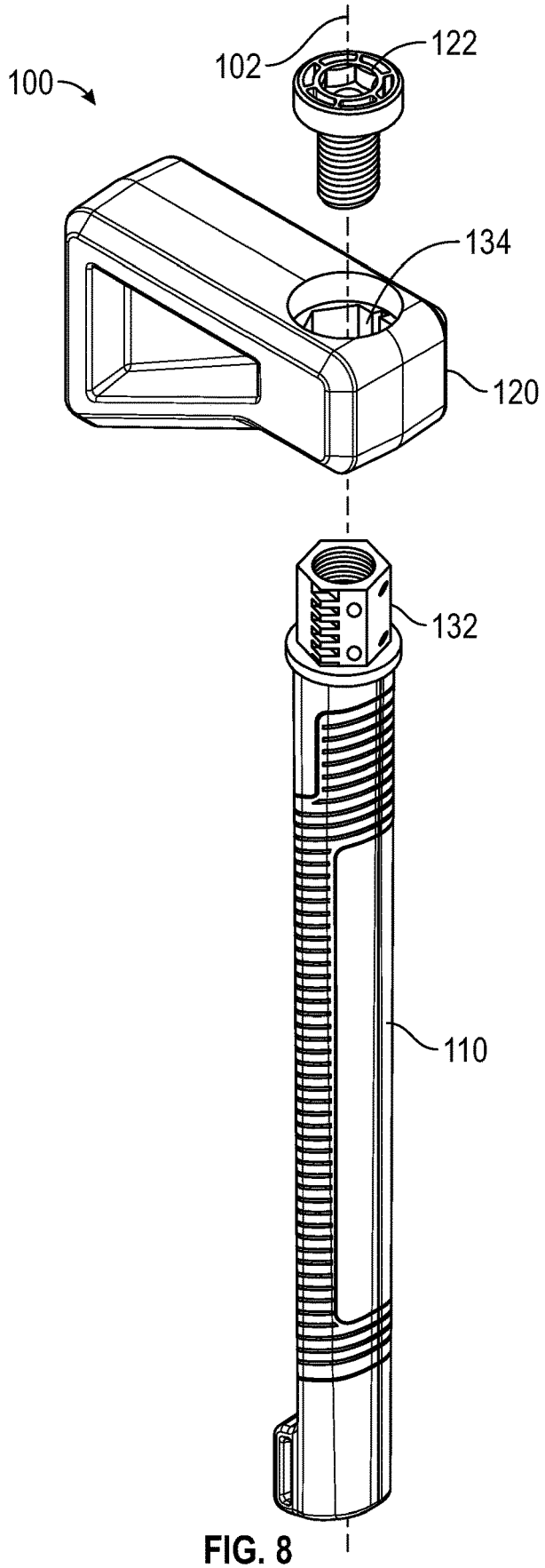
FIG. 8 is a partially exploded, perspective view of an embodiment of the exercise device.
Figure 9A:
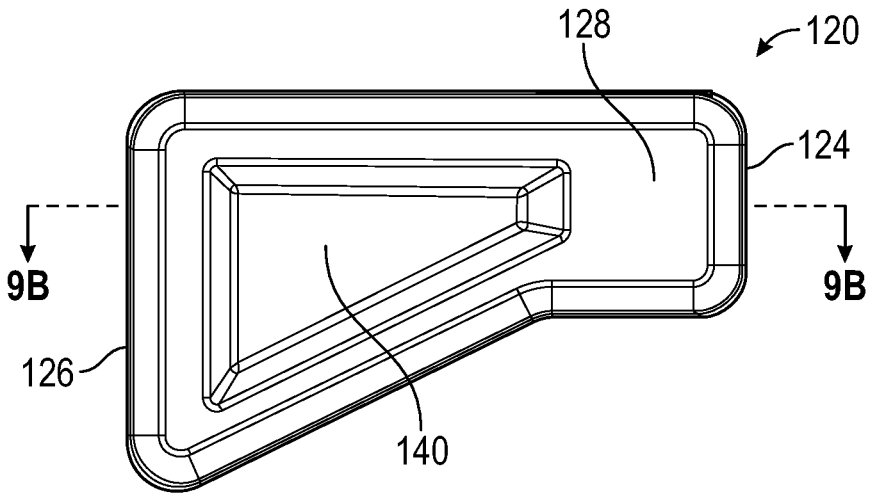
FIG. 9A is a side of an embodiment of a head for the exercise device.
Figure 9B:
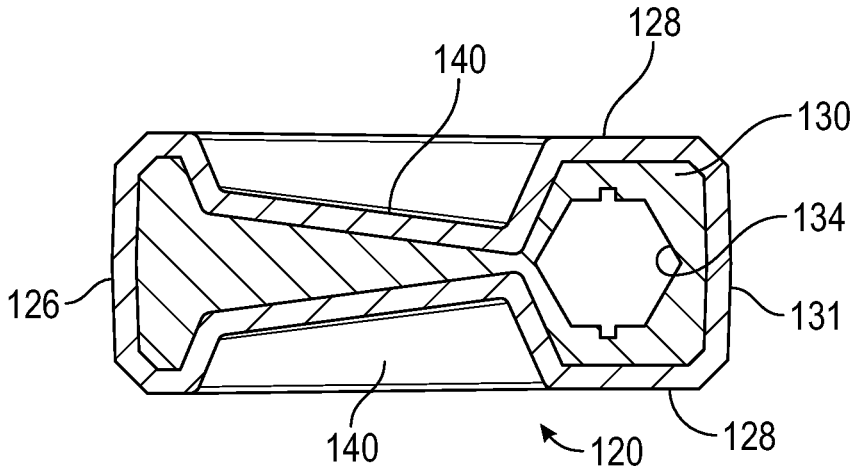
FIG. 9B is a sectional top view of the head of FIG. 9A, taken along the line 9B-9B.
Figure 10A:
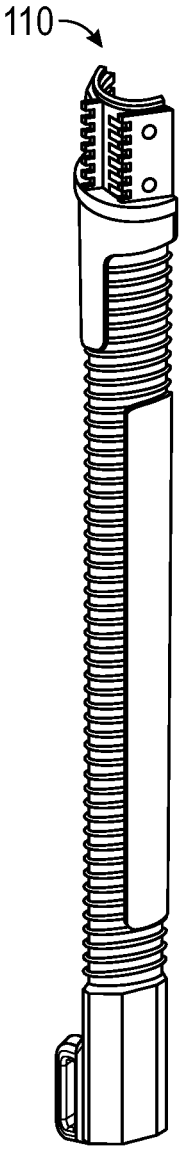
FIG. 10A is a perspective view of an embodiment of a portion of a handle for the exercise device.
Figure 10B:
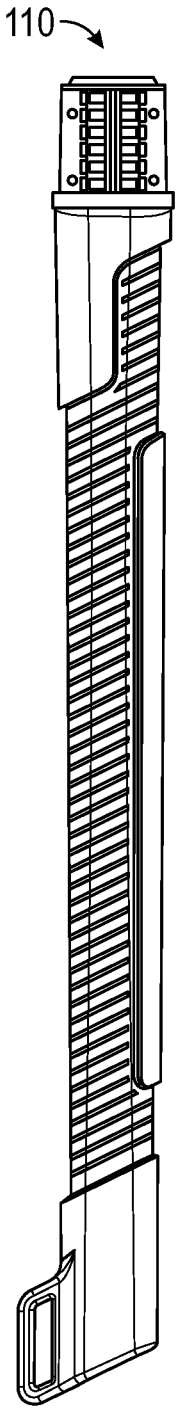
FIG. 10B is an outer side view of the handle of FIG. 10A.
Figure 10C:
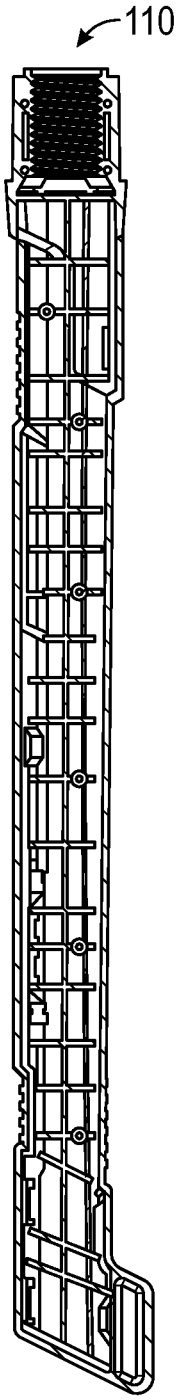
FIG. 10C is an inner side view of the handle of FIG. 10A.
Figure 11A:
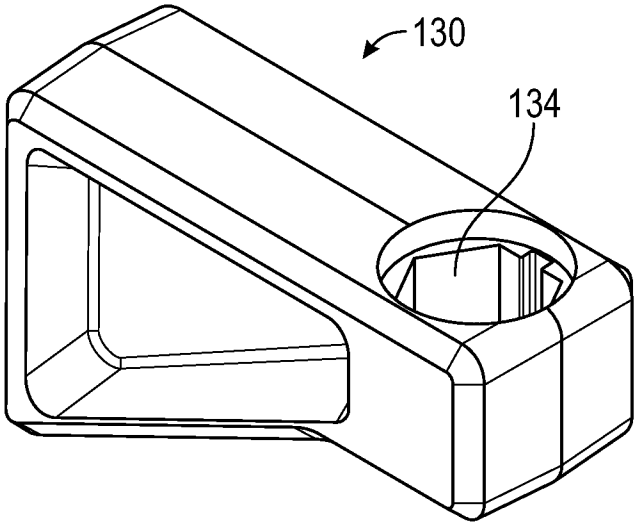
FIGS. 11A-11D are perspective, top, left side and rear views, respectively, of an interior core of a head of the exercise device.
Figure 11B:
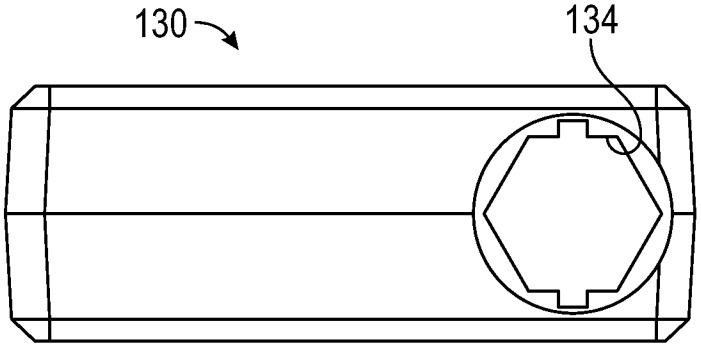
Figure 11C:
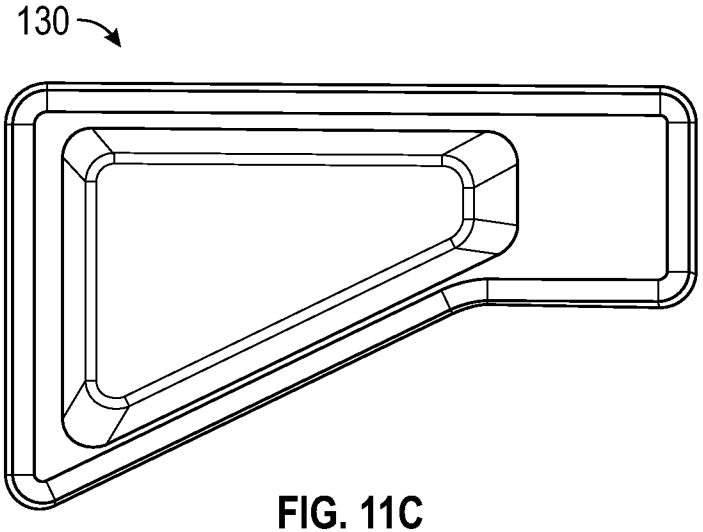
Figure 11D:
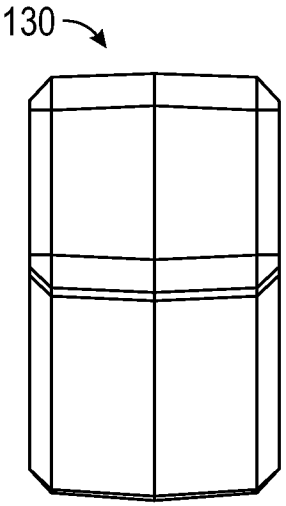
Figures 12A, 12B, 12C, 12D:
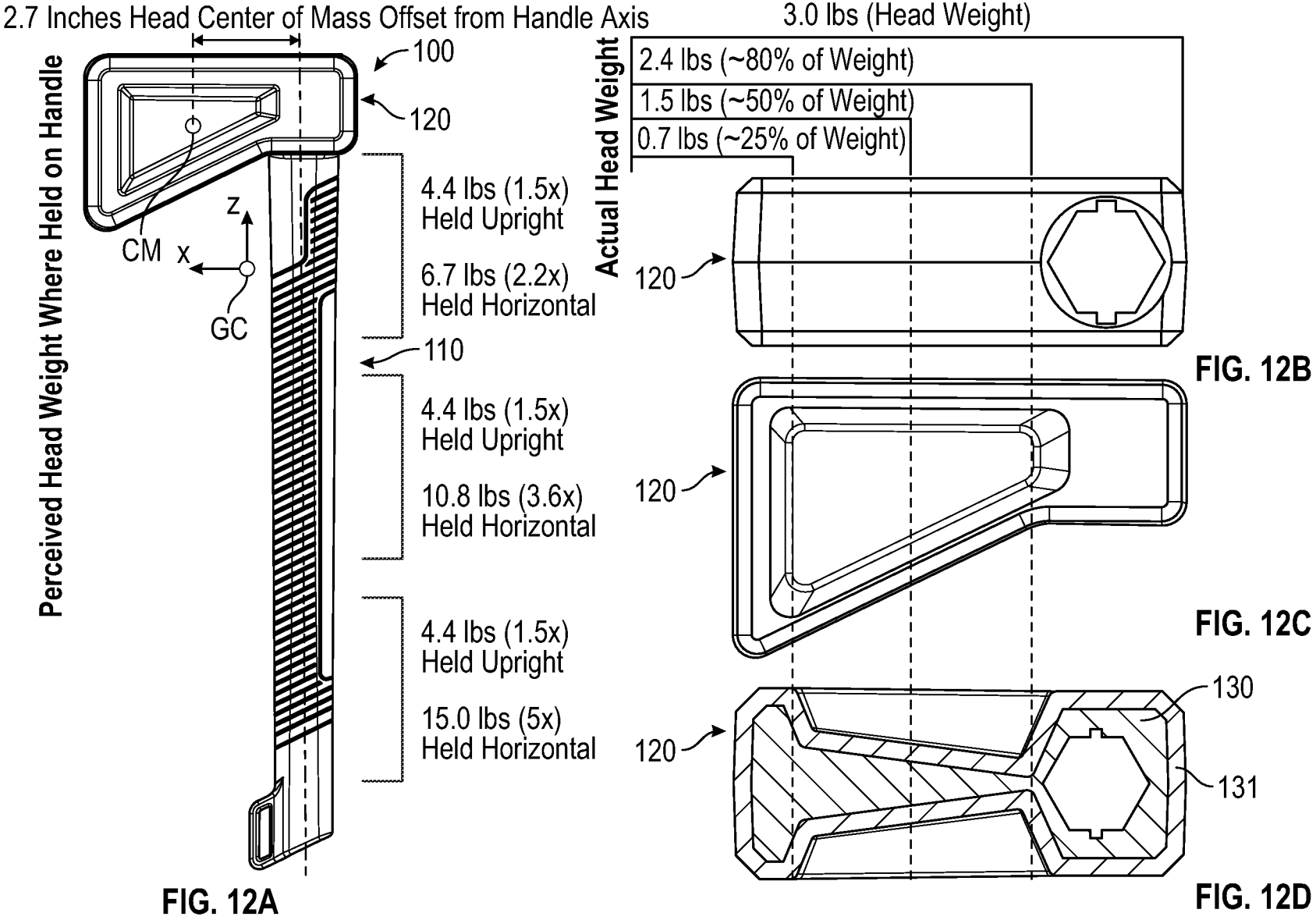
FIG. 12A is an annotated side view of an embodiment of the exercise device.
FIGS. 12B-12D are top, left side and top sectional views, respectively, of the head of the device of FIG. 12A.
Figure 13A:
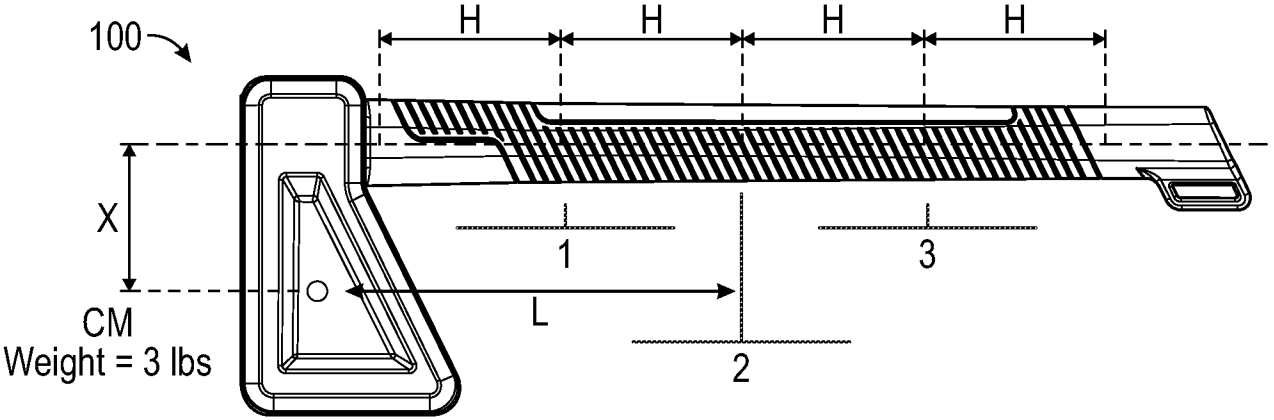
FIG. 13A is an annotated side view of the exercise device of FIGS. 12A-12D as used in a vertical orientation.
Figure 13C:
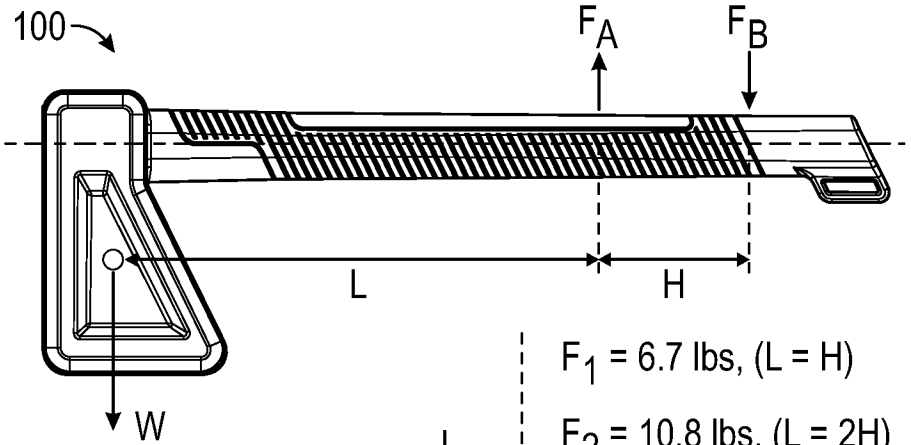
FIGS. 13B and 13C are annotated side views of the exercise device of FIG. 13A as used in a horizontal orientation.
Figure 13B:
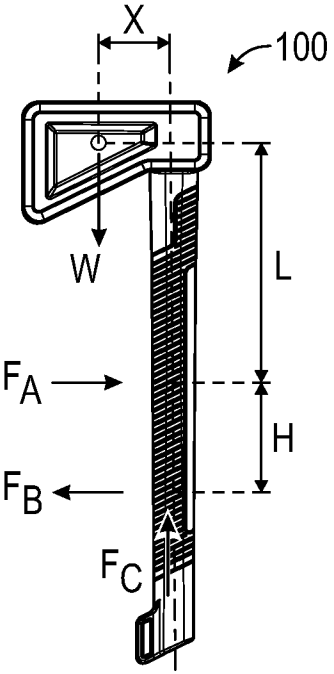
Figures 14A, 14B, 14C, 14D:
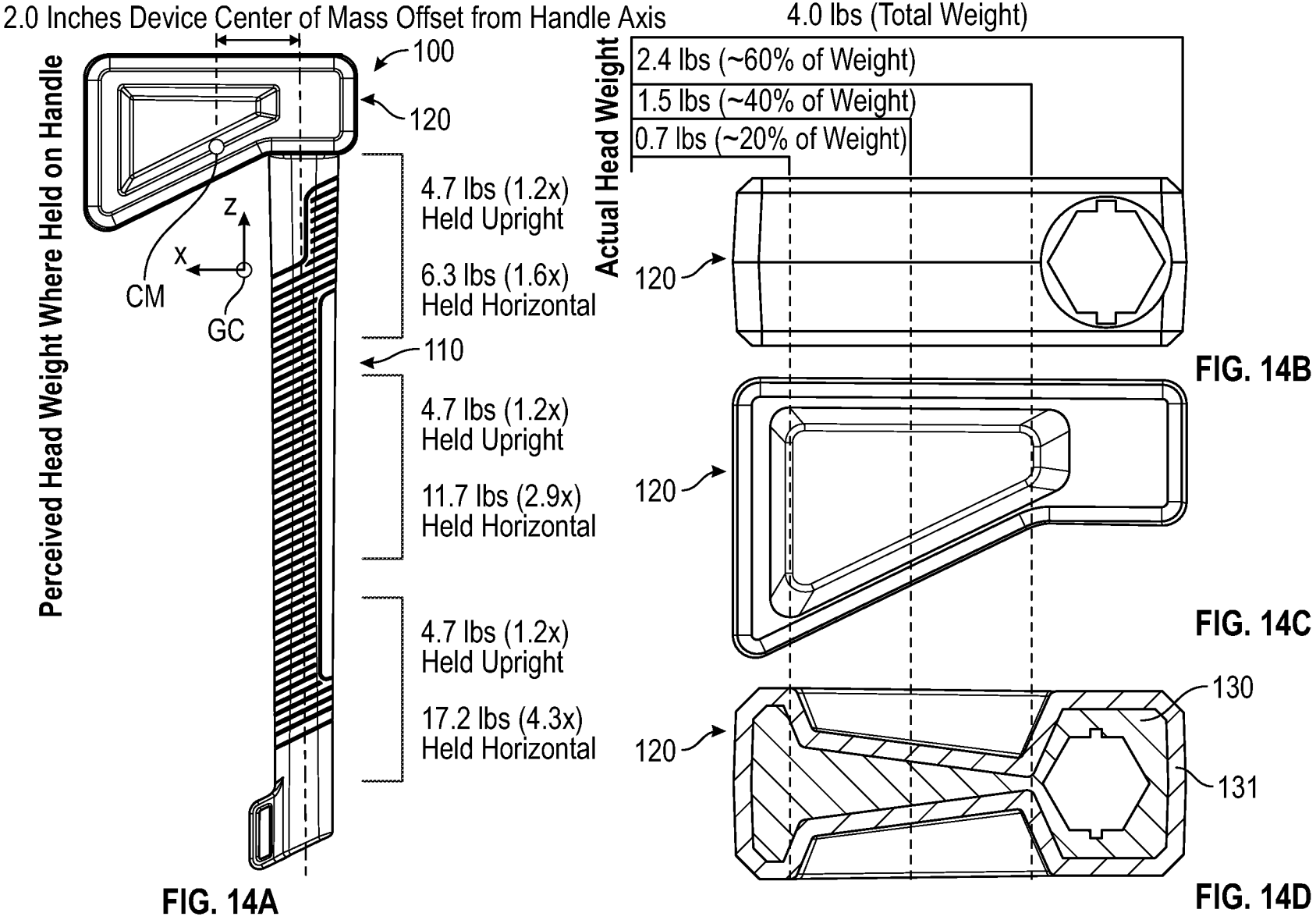
FIG. 14A is an annotated side view of another embodiment of the exercise device.
FIGS. 14B-14D are top, left side and top sectional views, respectively, of the head of the exercise device of FIG. 14A.
Figure 15A:
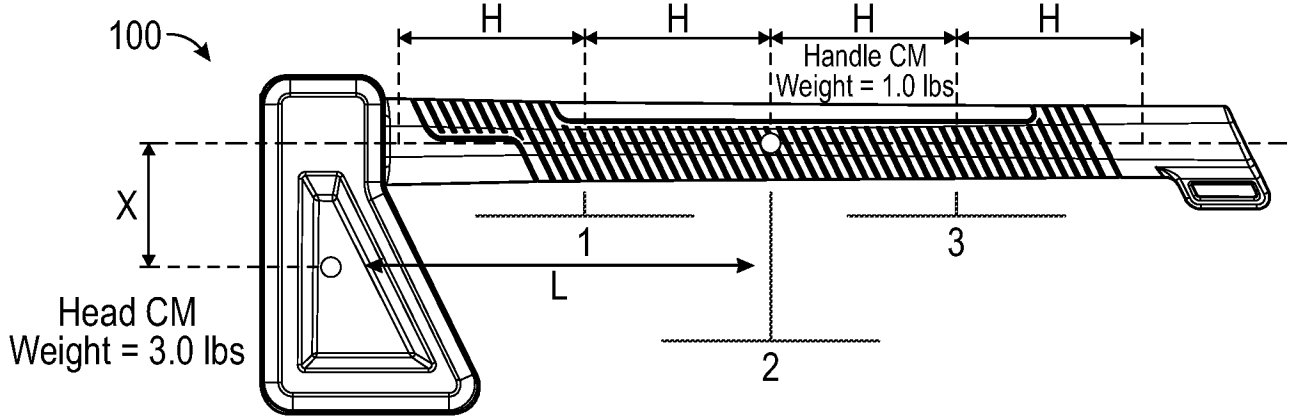
FIG. 15A is an annotated side view of the exercise device of FIGS. 14A-14D as used in a vertical orientation.
Figure 15C:
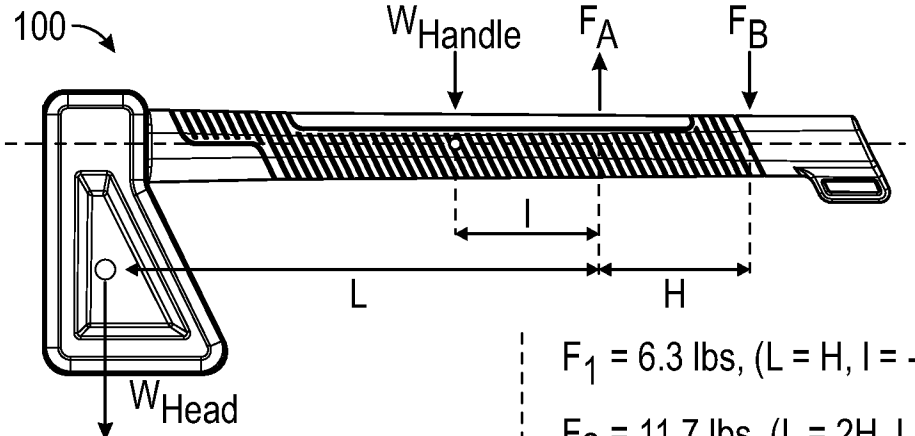
FIGS. 15B and 15C are annotated side views of the exercise device of FIG. 15A as used in a horizontal orientation.
Figure 15B:
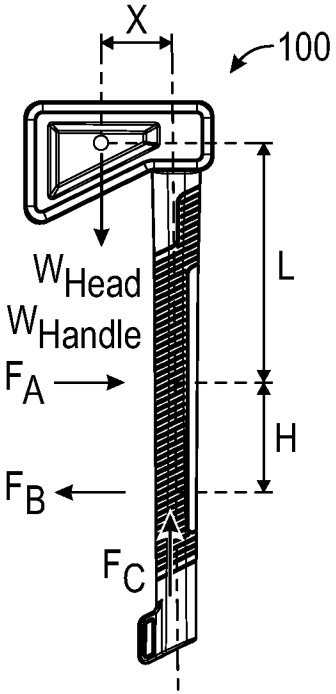

In some versions, one of the handle 110 and the head 120 can include a spline 132, and the other of the handle 110 and the head 120 can include a groove 134 that is configured to couple with the spline 132. In the example of FIG. 8, the spline 132 is on the handle 110 and the groove 134 is in the head 120.

In operation with the system or method, the handle 110 can be gripped by the user at various positions along the length of the shaft of the handle 110, and in generally vertical or generally horizontal orientations. For example, when the handle distal portion 112 is gripped by the user and the handle 110 is vertical, a total perceived weight of the exercise device perceived by the user can be at least about 10% greater than the head weight. Optionally, the total perceived weight can be not greater than about 100% of the head weight.

In another example, when the handle distal portion 112 is gripped by the user and the handle 110 is horizontal, a total perceived weight of the exercise device 100 perceived by the user can be at least about 25% greater than the head weight. Optionally, the total perceived weight can be not greater than about 150% of the head weight.

In still another example, when the handle middle portion 116 is gripped by the user and the handle 110 is vertical, a total perceived weight of the exercise device 100 perceived by the user can be at least about 25% greater than the head weight, and/or not greater than about 150%. When the handle middle portion 116 is gripped by the user and the handle 110 is horizontal, a total perceived weight of the exercise device 100 perceived by the user can be at least about 50% greater than the head weight, and/or not greater than about 200% of the head weight, in some versions.

In additional embodiments, when the handle proximal portion 114 is gripped by the user and the handle 100 is vertical, a total perceived weight of the exercise device 100 perceived by the user can be at least about 50% greater than the head weight, and/or not greater than about 200% of the head weight. When the handle proximal portion 114 is gripped by the user and the handle 110 is horizontal, a total perceived weight of the exercise device 100 perceived by the user can be at least about 100% greater than the head weight, and/or not greater than about 300% of the head weight.

Embodiments of an exercise device 100 can include a handle 110 having a handle weight. A head 120 can be coupled to the handle 110, such as with a single fastener 122, adjacent a proximal end 124 of the head 120. The head 120 can be generally axe-shaped. A distal end 126 of the head 120 can be blunt. A portion of each of the proximal end 124 and the blunt distal end 126 can be generally planar. Examples of the exercise device 100 can comprise a blunt axe and/or an axe-shaped sledge hammer In some versions, the handle weight can be not greater than about 10% of the head weight, such as not greater than about 20%, not greater than about 30%, not greater than about 40%, or even not greater than about 50% of the head weight.

The head 120 can comprise a core 130 that is overmolded with, for example, a polymer 131. The core 130 can comprise a polymer, aluminum, steel, etc. The core 130 can comprise fasteners, such as screws, to couple together portions of the core 130.

In one example, the handle 110 can include no metallic components, other than fasteners such as screws.

Embodiments of the head weight can be distributed asymmetrically with respect to a geometric center of the head 120 in at least one of x, y and z-axes of the head 120.

In some versions, the portions of the proximal end 124 and blunt distal end 126 of the head 120 can be parallel or substantially parallel to each other. For example, they can be within about 1 degree, 2 degrees and up to about 20 degrees of being parallel to each other.

The head 120 can comprise side walls 128 on opposing lateral sides thereof. The sidewalls 128 can be parallel or substantially parallel to each other. For example, they can be within about 1 degree, 2 degrees and up to about 10 degrees of being parallel to each other.

In another example, both the proximal and distal ends 124, 126 of the head 120 can be trapezoidal or semi-trapezoidal in shape, as can the sidewalls 128.

Examples of the head 120 can have a center of mass that is spaced apart from an axis 102 of the handle 110 by, for example, at least about 1 cm, such as at least about 2 cm, at least about 3 cm, at least about 4 cm, at least about 5 cm, or even at least about 6 cm apart from the axis 102.

In some embodiments, at least about 10% of the head weight, or total weight of the device 100, can be located within about 2.5 cm of the handle axis, such as at least about 20%, at least about 30%, at least about 40%, or even at least about 50% of the head weight.

In other embodiments, not greater than about 60% of the head weight, or total weight of the device 100, can be located within about 2.5 cm of the handle axis 102, such as not greater than about 50%, not greater than about 40%, or even not greater than about 30% of the head weight.

In alternate embodiments, at least about 30% of the head weight can be located within about 6 cm of the handle axis 102, such as at least about 40%, at least about 50%, at least about 60%, or even at least about 70% of the head weight.

In still other embodiments, not greater than about 80% of the head weight can be located within about 6 cm of the handle axis 102, such as not greater than about 70%, not greater than about 60%, or even not greater than about 50% of the head weight.

In some versions, at least about 10% of the head weight can be located within about 2.5 cm of the distal end 126 of the head 120, such as at least about 15%, at least about 20%, at least about 25%, at least about 30%, or even at least about 35% of the head weight.

In other versions, not greater than about 40% of the head weight can be located within about 2.5 cm of the distal end 126 of the head 120, such as not greater than about 35%, not greater than about 30%, or even not greater than about 25% of the head weight.

Embodiments can further include concave recesses 140 formed in lateral sides of the head 120. For example, each concave recess 140 can be asymmetric in at least one dimension or at least two dimensions. The head 120 can comprise a head width 142, and each concave recess 140 can extend into the head 120 in a range of at least about 5% of the head width 142, such as at least about 10%, at least about 15%, or even at least about 20% of the head width 142. In addition or alternatively, each concave recess 142 can extend into the head 120 by not greater than about 40% of the head width 142, such as not greater than about 35%, not greater than about 30%, not greater than about 25%, or even not greater than about 20% of the head width 142.

In some examples, the handle 110 can comprise a handle distal portion 112 adjacent the head 120, a handle proximal portion 114 opposite the handle distal portion 112, and a handle middle portion 116 located between the handle proximal and distal portions 114, 112, each of which can be configured to be gripped by a user.

In some embodiments, when the handle distal portion 112 can be gripped by the user and the handle 100 is vertical or substantially vertical, a total perceived weight (or moment) of the exercise device 100 perceived by the user can be at least about 50% greater than the head weight, such as at least about 100%, at least about 150%, at least about 200%, or even at least about 250% greater than the head weight. In addition or alternatively, the total perceived weight can be not greater than about 250% of the head weight, such as not greater than about 200%, not greater than about 150%, or even not greater than about 100% of the head weight.

In other embodiments, when the handle distal portion 112 is gripped by the user and the handle 110 is horizontal or substantially horizontal, a total perceived weight (or moment) of the exercise device 100 perceived by the user can be at least about 10% greater than the head weight, such as at least about 25%, at least about 50%, at least about 75%, at least about 100%, at least about 150%, or even at least about 200% greater than the head weight. It also can be not greater than about 200% of the head weight, such as not greater than about 150%, not greater than about 100%, or even not greater than about 50% of the head weight.

Analogous values can be provided for other grip portions of the handle 110. For example, when the handle middle portion 116 is gripped by the user and the handle 110 is vertical, a total perceived weight of the exercise device 100 perceived by the user can be at least about 50% greater than the head weight, such as at least about 100%, at least about 150%, at least about 200%, or even at least about 250% greater than the head weight. It also can be not greater than about 250% of the head weight, such as not greater than about 200%, not greater than about 150%, or even not greater than about 100% of the head weight.

In still other embodiments, when the handle middle portion 116 is gripped by the user and the handle 110 is horizontal, a total perceived weight of the exercise device 100 perceived by the user can be at least about 100% greater than the head weight, such as at least about 150%, at least about 200%, at least about 250%, at least about 300%, at least about 350%, or even at least about 300% greater than the head weight. It also can be not greater than about 250% of the head weight, such as not greater than about 200%, or even not greater than about 150% of the head weight.

In other versions, when the handle proximal portion 114 is gripped by the user and the handle 110 is vertical, a total perceived weight of the exercise device 100 perceived by the user can be at least about 50% greater than the head weight, such as at least about 100%, at least about 150%, at least about 200%, or even at least about 250% and/or, for example, not greater than about 250%, such as not greater than about 200%, not greater than about 150%, or even not greater than about 100% of the head weight.

In alternate versions, when the handle proximal portion 114 is gripped by the user and the handle 110 is horizontal, a total perceived weight or moment of the exercise device 100 perceived by the user can be at least about 200% greater than the head weight, such as at least about 300%, at least about 400%, at least about 500%, at least about 600%, or even at least about 650% and/or, for example, not greater than about 700%, such as not greater than about 600%, not greater than about 500%, not greater than about 400%, or even not greater than about 300% of the head weight.

Examples of the handle proximal portion 114 can comprise a handle loop 118 configured to be secured to a wrist strap 150 of a user of the exercise device 100. The wrist strap 150 can include a connection loop configured to be connected to the handle loop. In addition, the wrist strap can include a strap loop configured to be connected to a wrist of a user. The connection loop and the strap loop can be coupled together, as by sewing, for example. The connection loop can comprise a smaller, lighter material than the strap loop, as shown.

Other examples can include a single handle 100 with more than one interchangeable heads 120 that differ from each other. Some versions can include light, regular and heavy heads 120. For example, a light version can include a head weight of about 1.3 pounds, with a core formed from a polymer, such as two molded halves screwed together. The light version can have a perceived weight range of about 2.5 to about 7.5 pounds, for example. The regular model can comprise the various embodiments described herein. Examples of the heavy version can include a head weight of about 6.2 pounds with a metallic core. The heavy version can have a perceived weight range of about 9 to about 32.5 pounds, in some versions.

In some examples, the perceived head weight (just the head weight) by the user compared to the actual weight of the head, when holding each version of device at different points on the handle, can be as follows.

Proximal handle position.
Lightweight Horizontal: 220% of head weight
Lightweight Vertical: 140% of head weight
Standard Horizontal: 220% of head weight
Standard Vertical: 150% of head weight
Heavyweight Horizontal: 220% of head weight
Heavyweight Vertical: 150% of head weight
Central handle position.
Lightweight Horizontal: 360% of head weight
Lightweight Vertical: 140% of head weight
Standard Horizontal: 360% of head weight
Standard Vertical: 150% of head weight
Heavyweight Horizontal: 360% of head weight Heavyweight Vertical: 150% of head weight
Distal handle position.
Lightweight Horizontal: 500% of head weight
Lightweight Vertical: 140% of head weight
Standard Horizontal: 500% of head weight
Standard Vertical: 150% of head weight
Heavyweight Horizontal: 500% of head weight
Heavyweight Vertical: 150% of head weight In other examples, the perceived total weight (of both the head and handle) by the user, when holding each version of the device at different points on the handle, can be as follows.

Proximal handle position.
Lightweight Horizontal: 110% of total weight
Lightweight Vertical: 110% of total weight
Standard Horizontal: 160% of total weight
Standard Vertical: 120% of total weight
Heavyweight Horizontal: 190% of total weight
Heavyweight Vertical: 130% of total weight
Central handle position.
Lightweight Horizontal: 240% of total weight
Lightweight Vertical: 110% of total weight
Standard Horizontal: 290% of total weight
Standard Vertical: 120% of total weight
Heavyweight Horizontal: 320% of total weight
Heavyweight Vertical: 130% of total weight
Distal handle position.
Lightweight Horizontal: 380% of total weight
Lightweight Vertical: 110% of total weight
Standard Horizontal: 430% of total weight
Standard Vertical: 120% of total weight
Heavyweight Horizontal: 460% of total weight
Heavyweight Vertical: 130% of total weight Embodiments can be incorporated into a user fitness routine with essential, functional movement with crafted equipment. With innovative functionality and design, the device can work lesser used muscles of the user. Embodiments include a packable size that travels well for on-the-go workouts. Examples can include multiple weight loads, based on hand positioning, to readily allow users to easily level up or down. Designs include reinforced materials and a highly ergonomic design.

The system and method include a fitness program to use repetitive chopping motions, such as those shown and described at https://chopfit.com/, as the foundation for a full-body cardio and strength workout. The weight distribution in the device enables loads that engage both stabilizer muscles and power centers of the user. The workouts build grip strength, increase rotational power and train muscles to work together. Embodiments take endurance training to the next level with fast-paced circuits—working upper and lower body muscles at the same time. They also improve core stability with rotational motion. High-intensity circuits offer an excellent balance of cardio and strength, all in less than 20 minutes. Workouts can be performed anywhere there is room to move—in the gym or out.

Users can take interactive workouts on-the-go by downloading and using the phone app. The phone app can track user progress with a real-time dashboard. The phone app can provide guided instructions for getting the best results for each user.

This disclosure is meant to be illustrative of the principles and various embodiments. Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims. Numerous variations and modifications will become apparent to those skilled in the art once the above disclosure is fully appreciated. It is intended that the following claims be interpreted to embrace all such variations and modifications.

The various aspects, implementations or features of the described embodiments can be used separately or in any combination. The embodiments disclosed herein are modular in nature and can be used in conjunction with or coupled to other embodiments.

Consistent with the above disclosure, the examples of assemblies enumerated in the following clauses are specifically contemplated and are intended as a non-limiting set of examples.

What is claimed is:

1. An exercise device, comprising:
a handle having a handle axis and a handle weight;
a head removably coupled to a distal end of the handle with a single fastener adjacent a proximal end of the head, the head comprises a head weight, the head is axe-shaped, a distal end of the head is blunt, a portion of each of the proximal and distal ends of the head is planar, the head comprises a metallic core that is overmolded with a polymer, wherein the head weight is distributed asymmetrically with respect to a geometric center of the head in at least one of x, y and z-axes of the head; and
a total weight of the exercise device is at least about 2 pounds.

2. The exercise device of claim 1, wherein the handle weight is not greater than about 30% of the head weight, and further comprising a wrist strap extending from the handle and configured to be connected to a wrist of the user to restrain the exercise device during chopping motions by the user.

3. The exercise device of claim 1, wherein the handle comprises no non-fastener metallic components.

4. The exercise device of claim 1, wherein substantial entireties of the proximal and distal ends of the head are substantially parallel to each other.

5. The exercise device of claim 1, wherein the head comprises side walls on opposing lateral sides thereof, and the sidewalls are substantially parallel to each other.

6. The exercise device of claim 1, wherein the head comprises a center of mass that is spaced apart from the handle axis by at least about 4 cm.

7. The exercise device of claim 1, wherein at least about 25% of the head weight or total weight of the exercise device is located within about 2.5 cm of the handle axis, and not greater than about 60% of the head weight or total weight is located within about 2.5 cm of the handle axis.

8. The exercise device of claim 1, wherein at least about 50% of the head weight is located within about 6 cm of the handle axis, and not greater than about 80% of the head weight is located within about 6 cm of the handle axis.

9. The exercise device of claim 1, wherein at least about 20% of the head weight is located within about 2.5 cm of the distal end of the head, and not greater than about 50% of the head weight is located within about 2.5 cm of the distal end of the head.

10. The exercise device of claim 1, further comprising concave recesses formed in lateral sides of the head, each concave recess is asymmetric in at least one dimension, the head comprises a head width, each concave recess extends into the head in a range of at least about 10% of the head width to not greater than about 40% of the head width.

11. The exercise device of claim 1, wherein:

the handle comprises a handle distal portion adjacent the head, a handle proximal portion opposite the handle distal portion, and a handle middle portion located between the handle proximal and distal portions, each of which is configured to be gripped by a user;

the handle proximal portion comprises a loop configured to be secured to a hand strap of the user to restrain the exercise device during chopping motions by the user; and one of the handle and the head comprises a spline, and the other of the handle and the head comprises a groove configured to couple with the spline.

12. The exercise device of claim 11, wherein:

when the handle distal portion is gripped in a hand of the user and the handle is vertical, a total magnitude of force applied to the hand by the exercise device is at least about 30% greater than the actual head weight, and not greater than about 60% of the actual head weight; and when the handle distal portion is gripped in the hand of the user and the handle is horizontal, a total magnitude of force applied to the hand by the exercise device is at least about 400% greater than the actual head weight, and not greater than about 600% of the actual head weight.

13. The exercise device of claim 11, wherein:

when the handle middle portion is gripped in a hand of the user and the handle is vertical, a total magnitude of force applied to the hand by the exercise device is at least about 30% greater than the actual head weight, and not greater than about 60% of the actual head weight; and when the handle middle portion is gripped in the hand of the user and the handle is horizontal, a total magnitude of force applied to the hand by the exercise device is at least about 200% greater than the actual head weight, and not greater than about 300% of the actual head weight.

14. The exercise device of claim 11, wherein:

when the handle proximal portion is gripped in a hand of the user and the handle is vertical, a total magnitude of force applied to the at least one hand by the exercise device is at least about 30% greater than the actual head weight, and not greater than about 60% of the actual head weight; and when the handle proximal portion is gripped in the hand of the user and the handle is horizontal, a total magnitude of force applied to the hand by the exercise device is at least about 100% greater than the actual head weight, and not greater than about 200% of the actual head weight.

15. An exercise device, comprising:

a handle having a handle axis;

a head coupled to the handle, the head comprises a head weight that is distributed asymmetrically with respect to a geometric center of the head in at least one of x, y and z-axes of the head;

substantial entireties of the proximal and distal ends of the head are substantially parallel to each other;

side walls of the head are on opposing lateral sides of the head, and the sidewalls are substantially parallel to each other, wherein the head is axe-shaped and the distal end of the head is blunt;

the head comprises a metallic core that is overmolded with a polymer; and a total weight of the exercise device is at least about 2 pounds.

16. The exercise device of claim 15, wherein:

the head comprises a center of mass that is spaced apart from the handle axis by at least about 4 cm; and at least about 25% of the head weight is located within about 2.5 cm of the handle axis, and not greater than about 60% of the head weight is located within about 2.5 cm of the handle axis.

17. An exercise device, comprising:

a handle having a handle axis, a handle proximal portion, a handle middle portion and a handle distal portion;

a head coupled to the handle, and the head comprises a head weight, wherein the head is axe-shaped and a distal end of the head is blunt, wherein the head comprises a core that is over-molded with a polymer has been inserted after; wherein when the handle distal portion is gripped in a hand of the user and the handle is vertical, a total magnitude of force applied to the hand by the exercise device is at least about 10% greater than the head weight, and not greater than about 100% of the head weight;

when the handle middle portion is gripped in the hand of the user and the handle is vertical, a total magnitude of force applied to the hand by the exercise device is at least about 25% greater than the head weight, and not greater than about 150% of the head weight; and when the handle proximal portion is gripped in the hand of the user and the handle is vertical, a total magnitude of force applied to the hand by the exercise device is at least about 50% greater than the head weight, and not greater than about 200% of the head weight; and a wrist strap extending from the handle and configured to be connected to a wrist of the user to restrain the exercise device during chopping motions by the user.

* * * * *